United States Patent [19]

Gross

[11] 4,135,423

[45] Jan. 23, 1979

[54] AUTOMATIC RHYTHM GENERATOR

[75] Inventor: Glenn M. Gross, Chicago, Ill.

[73] Assignee: Norlin Music, Inc., Lincolnwood, Ill.

[21] Appl. No.: 748,727

[22] Filed: Dec. 9, 1976

[51] Int. Cl.[2] ..... G10H 1/02

[52] U.S. Cl. ..... 84/1.03; 84/DIG. 12

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,255,292 | 6/1966 | Park | 84/1.03 |
| 3,482,027 | 12/1969 | Okamoto et al. | 84/1.03 |
| 3,548,065 | 12/1970 | Freeman | 84/1.03 |
| 3,553,334 | 1/1971 | Freeman | 84/1.03 |
| 3,567,838 | 3/1971 | Tennes | 84/1.01 |
| 3,585,891 | 6/1971 | Schwartz | 84/1.03 |
| 3,760,088 | 9/1973 | Nakada | 84/1.03 |
| 3,763,305 | 10/1973 | Nakada et al. | 84/1.03 |
| 3,764,722 | 10/1973 | Southard | 84/1.03 |
| 3,840,691 | 10/1974 | Okamoto | 84/1.03 |
| 3,918,341 | 11/1975 | Bunger | 84/1.01 |

*Primary Examiner*—Robert K. Schaefer
*Assistant Examiner*—Vit W. Miska
*Attorney, Agent, or Firm*—Ronald J. Kransdorf; Jack Kail

[57] ABSTRACT

An automatic rhythm generator of an electrical musical instrument including a rhythm pattern generator for rhythmically selecting for actuation different ones of a plurality of instrumentation circuits to be sounded and a strobe pulse generating circuit for establishing the appropriate pulse width of a drive pulse needed by each instrumentation circuit for proper actuation thereof. The rhythm pattern generator circuit selectively enables a plurality of drive gates respectively associated with the plurality of instrumentation circuits during selected ones of a succession of periodic rhythm cycles in accordance with a predetermined rhythm pattern. The strobe circuit is synchronized with the rhythm pattern generator and generates during each rhythm cycle a plurality of strobe pulses on a corresponding plurality of outputs respectively associated with the plurality of instrumentation circuits. Each of the strobe pulses has a width preselected for the instrumentation circuit with which it is associated. The enabled drive gates provide a drive pulse to their associated instrumentation circuits in response to, and having a pulse width proportional to that of, the strobe pulse applied thereto.

20 Claims, 3 Drawing Figures

AUTOMATIC RHYTHM GENERATOR

BACKGROUND OF THE INVENTION

This invention relates to circuitry for selectively actuating instrumentation circuits of an electrical musical instrument and, more particularly, to such circuitry used as an automatic rhythm generator.

Automatic rhythm playing or generating systems for use with electronic organs or similar instruments are well known in the art. Examples of such circuits are shown in a large number of United States patents including U.S. Pat. No. 3,548,065 of Freeman issued Dec. 15, 1970, to Chicago Musical Instrument Co., now Norlin Music, Inc., the assignee of the present application; U.S. Pat. No. 3,553,334 of Freeman issued Jan. 5, 1971, to Chicago Musical Instrument Co.; U.S. Pat. No. 3,567,838 of Tennes issued Mar. 2, 1971, to Hammond Corporation; U.S. Pat. No. 3,760,088 of Nakada issued Sept. 18, 1973, to Nippon Gakki Seizo Kabushika Kaisha; U.S. Pat. No. 3,763,305 of Nakada et al. issued Oct. 2, 1973, to Nippon Gakki Seizo Kabushiki; U.S. Pat. No. 3,764,722 of Southard issued Oct. 9, 1973, to C. G. Conn Ltd.; and U.S. Pat. No. 3,840,691 of Okamoto issued Oct. 8, 1974, to Nippon Gakki Seizo Kabushiki. Reference may be had to these patents for a detailed description of the different types of circuitry and the various techniques by which rhythm signals and tones may be automatically generated.

Briefly, all such circuits employ a plurality of rhythm voice or instrumentation circuits which produce tone signals respectively corresponding to a plurality of different musical instruments and suitable circuitry for actuating preselected ones of the instruments during selected ones of a succession of rhythm cycles. The tempo or rate at which the rhythm cycles are generated is customarily established by an oscillator or rhythm clock which is variable in frequency. In such circuits, different rhythm patterns are selected through means of manually actuateable switches to choose different rhythm patterns such as rhythms for a march, tango, swing, cha-cha-cha, rock. The different instrumentation circuits simulate different percussion instruments such as blocks, bass drum, brush, cymbal, snare drum, etc. or even non-percussion instruments.

Depending upon the rhythm pattern selected, none, one or plural instrumentation circuits are actuated during each rhythm cycle. For example, with the rhythm pattern for swing selected, the bass drum and brush instrument circuits may be actuated on the first rhythm cycle, no instruments actuated during the second and third rhythm cycles, the snare drum actuated during the fourth rhythm cycle, no instrument actuated during the fifth rhythm cycle, the brush instrument again actuated on the sixth rhythm cycle and so on in like manner for the next six rhythm cycles.

Each of the instrumentation circuits require a drive pulse applied thereto of appropriate width for proper actuation. Typically, each of the instrumentation circuits comprises a band pass filter having a high Q characteristic that produces an exponentially decaying sine wave on its output having a frequency equal to the resonant frequency of the filter. This sine wave output of each instrumentation circuit is produced when a rectangular wave drive pulse is applied to its input. The width of the input drive pulse should be approximately equal to one-fourth the period of the resonant frequency, for a drive pulse of this width when applied to the instrumentation circuit, will result in an output signal of optimum characteristics with regard to amplitude and distortion.

In known automatic rhythm systems, drive pulses of suitable width have been provided by means of monostable multivibrators or other suitable pulse shaping circuits. The monostable multivibrators, in turn, are driven by pulses of arbitrary widths without regard to the needs of the instrumentation circuit.

Disadvantageously, such monostable multivibrators and pulse shaping circuits are not readily amenable to embodiment in integrated circuit form together with the other parts of the automatic rhythm generator circuitry. Accordingly, the cost reducing and other benefits derived by providing the entire automatic rhythm generator circuitry in integrated circuit form have not heretofore been obtained.

SUMMARY OF THE INVENTION

The principal object of the present invention is to provide an automatic rhythm generator in which each of a plurality of instrumentation circuits employed therein is provided with a drive pulse of an appropriate width as needed thereby for proper operation through means of circuitry suitable for implementation in integrated circuit form together with the other component circuits of the generator to thereby reduce the cost thereof relative to known automatic rhythm generators.

In keeping with this objective, the rhythm generator is provided with means for generating a plurality of strobe pulses respectively associated with the plurality of instrumentation circuits having pulse widths preselected for the instrumentation circuits with which they are respectively associated. Also provided are means responsive to generation of a strobe pulse for a chosen instrumentation circuit to apply a drive pulse thereto of appropriate width which is proportional to the preselected width of the strobe pulse.

In a preferred embodiment of the invention described hereinafter, the preselected instrumentation circuits are chosen during preselected ones of a succession of periodic rhythm cycles by means of a rhythm pattern generator. During each rhythm cycle the rhythm pattern generator produces pulses on preselected ones of a plurality of outputs thereof respectively associated with the plurality of instrumentation circuits. A control circuit also generates during each rhythm cycle a plurality of strobe pulses on a plurality of outputs respectively associated with the plurality of instrumentation circuits. Each strobe pulse has a width preselected for the instrumentation circuit with which it is associated, and each instrumentation circuit receives a drive pulse of appropriate width from a logic gate associated therewith whenever the logic gate is enabled by a rhythm pulse during the receipt of a strobe pulse. When both a strobe pulse and rhythm pulse are applied to the inputs of one of the logic gates, the logic gate provides a drive pulse to its associated instrumentation circuit equal to the width of the strobe pulse provided thereto.

An advantageous feature of the automatic rhythm generator is that the strobe pulse generating means thereof includes means for synchronizing generation of the strobe pulses with establishment of the periodic rhythm cycles. In the preferred embodiment, each strobe pulse begins at the beginning of each rhythm cycle and terminates at different times during the rhythm cycle depending upon the width that has been preselected therefor. The synchronization ensures against generation of a strobe pulse before initiation of a rhythm pulse associated therewith.

A further advantageous feature of the automatic rhythm generator is that the strobe pulse generating means includes a strobe clock or oscillator, means for counting cycles of the oscillator and means responsive to the counting means for providing the strobe pulses. The frequency of the strobe clock or oscillator is independent of the frequency of the rhythm clock and is higher than the highest frequency thereof. Because of the frequency independence of the strobe clock, changes in tempo have no effect upon the drive pulses.

The foregoing objects, features and advantages of the present invention will be made more apparent and further objects, features and advantages of the invention will be disclosed in the description of the preferred embodiment.

BRIEF DESCRIPTION OF THE DRAWING

The following description of the preferred embodiment will be given with reference to the several views of the drawing, in which.

FIGS. *2a–2r*, inclusive, are representative comparative timing diagrams of waveforms developed by different parts of the automatic rhythm generator of FIG. 1.

DESCRIPTION OF THE PREFERRED EMBODIMENT

Figure 1:
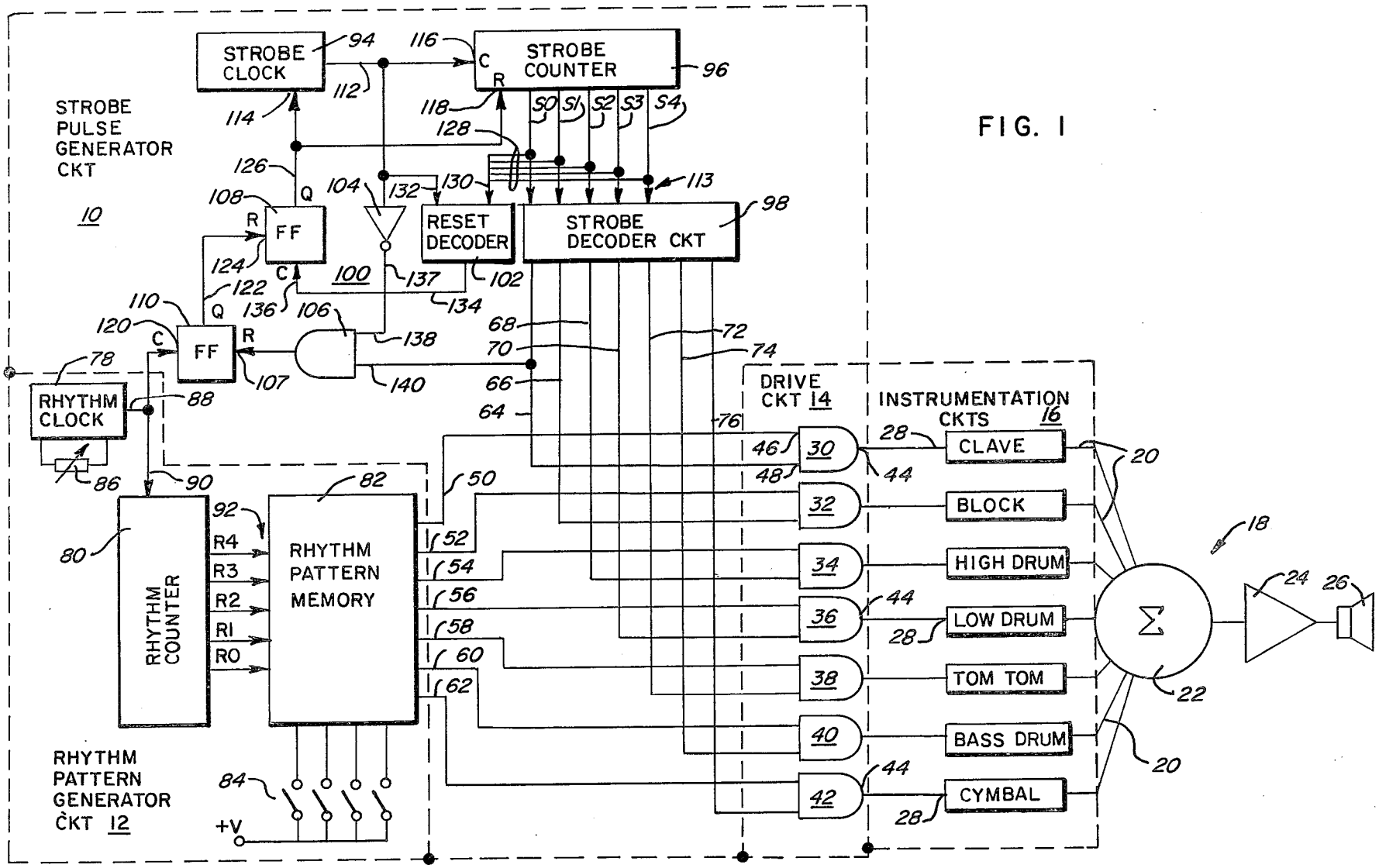
FIG. 1 is a schematic, partially in block diagram form and partially in circuit logic form, of a preferred embodiment of the automatic rhythm generator of the present invention.

Referring now to FIG. 1, a preferred embodiment of the automatic rhythm generator is seen to comprise a strobe pulse generator circuit 10, a rhythm pattern generator circuit 12, a drive circuit 14, a plurality of instrumentation circuits 16 and an output circuit 18. The plurality of instrumentation circuits 16 include seven different circuits respectively labeled CLAVE, BLOCK, HIGH DRUM, LOW DRUM, TOM-TOM, BASS DRUM and CYMBAL. Each of these instrumentation circuits 16 has an output 20 on which an audio output signal corresponding to the musical instrument designated by its label is produced when actuated. The outputs 20 of all of the instrumentation circuits 16 are applied to a summing circuit 22 which sums the audio output signals and applies them to an amplifier 24. The amplified rhythm signals produced by amplifier 24 are applied to a suitable speaker system 26 which produces corresponding audible sound waves. The strobe pulse generator circuit 10, the rhythm pattern generator 12 and the drive circuit 14 all function together to actuate selected ones of the instrumentation circuit 16 in accordance with a preselected rhythm.

Each of the instrumentation circuits 16 has an input 28 and produces its audio output signal in response to application of a drive pulse thereto. The different instrumentation circuits 16 produce audio output signals which differ in both frequency and duration according to the different instruments to which they correspond. In the embodiment of FIG. 1, each of the instrumentation circuits 16 except the one labeled CYMBAL comprises a band pass filter having a high Q characteristic. When a drive pulse is applied to the input 28 of one of these instrumentation circuits 16, it produces for a short duration a generally sinusoidal output wave at the resonant frequency thereof that decays in a generally exponential fashion. When a drive pulse is applied to the input 28 of the CYMBAL instrumentation circuit, it produces for a short duration a waveform containing white noise to simulate the sound of a cymbal.

The resonant frequency for each of the filter type instrumentation circuits 16 is selected to correspond to the frequency of sound produced by its associated instrument. For example, the resonant frequency for the block is higher than that of the low drum which, in turn, is higher than that of the bass drum. The filter type instrumentation circuits 16 are arranged from top to bottom as depicted in FIG. 1 in an order of descending resonant frequency. Because each of the filter type instrumentation circuits 16 has a different resonant frequency, they each require a drive pulse of a different width appropriate therefor in order to operate properly. Specifically, the width of the drive pulse for a given filter type instrumentation circuit 16 should be approximately equal to one-fourth of the period of the resonant frequency. For example, if the resonant frequency for the clave is 2.5 kHz, the pulse width of the drive pulse applied to input 28 of the CLAVE instrumentation circuit should be approximately 0.1 msec. If the pulse width of the drive pulse applied to an instrumentation circuit is greater than the width which is appropriate for the instrumentation circuit, the audio output signal produced in response to the drive pulse will have undesirable distortions. The width of the drive pulse needed by the CYMBAL instrumentation circuit for proper operation is determined by a rise time characteristic of one of the circuit elements thereof.

In keeping with the principal object of the present invention, the drive circuit 14 in cooperation with the strobe pulse generating circuit 10 and the rhythm pattern generator 12 functions to provide a plurality of strobe pulses respectively associated with the plurality of instrumentation circuits 16 having pulse widths appropriate for the instrumentation circuits 16 with which they are associated. The drive circuit 14 comprises seven AND gates 30, 32, 34, 36, 38, 40 and 42 respectively associated with the seven instrumentation circuits labeled CLAVE, BLOCK, HIGH DRUM, LOW DRUM, TOM-TOM, BASS DRUM and CYMBAL. Each drive circuit 14 has an output 44 connected with the input 28 of its associated instrumentation circuit 16, a rhythm input 46 and a strobe input 48. The rhythm inputs 46 of the seven AND gates 30–42 are respectively connected with seven outputs 50, 52, 54, 56, 58, 60 and 62 of the rhythm pattern generator circuit 12. The strobe inputs 48 of the seven AND gates 30–42 are respectively connected with seven outputs 64, 66, 68, 70, 72, 74 and 76 of the strobe pulse generator circuit 10.

The rhythm pattern generator circuit 12 establishes periodic rhythm cycles and chooses one or more of the instrumentation circuits 16 for development of its output signal during selected ones of the rhythm cycles by generating 1-state rhythm pulses on appropriate ones of its outputs 50–62. When a 1-state drive pulse is applied to the rhythm input 46 of one of the drive circuit AND gates 30–42, the gate is enabled to respond to a strobe pulse applied to its strobe input 48. The pulse widths of all the rhythm pulses are of equal duration which is not less than the longest drive pulse desired. When an enabled one of the drive circuit AND gates receives a 1-state strobe pulse at its strobe input 48, it generates in response thereto a drive pulse on its output 44 substantially equal in width to the width of the strobe pulse. The widths of the strobe pulses are preselected in accordance with the needs of the instrumentation circuit 16 with which they are associated.

The rhythm pattern generator circuit 12 is conventional, comprising a rhythm clock 78, a rhythm counter 80, a programmable rhythm pattern memory 82 and a set of manually actuateable program or rhythm pattern selection switches 84. Such circuits are available in integrated circuit form as standard items such as the MCM6550, 7168-Bit Static Read Only Memory Rhythm Generator available from Motorola Semiconductor Products Inc., and reference may be made to their 1975 publication *Semiconductor Data Library,* Volume 7/Series A at page 3–4 et seq for a detailed description of the operating characteristics of this circuit. Similar circuits are shown in several U.S. patents including U.S. Pat. No. 3,840,691 of Okamoto issued Oct. 8, 1974, to Nippon Gakki Seizo Kabushiki Kaisha capable of performing the needed functions of the rhythm pattern generator circuit described herein. Accordingly, only a brief description of the rhythm pattern generator circuit 12 will be given.

Figure 2:
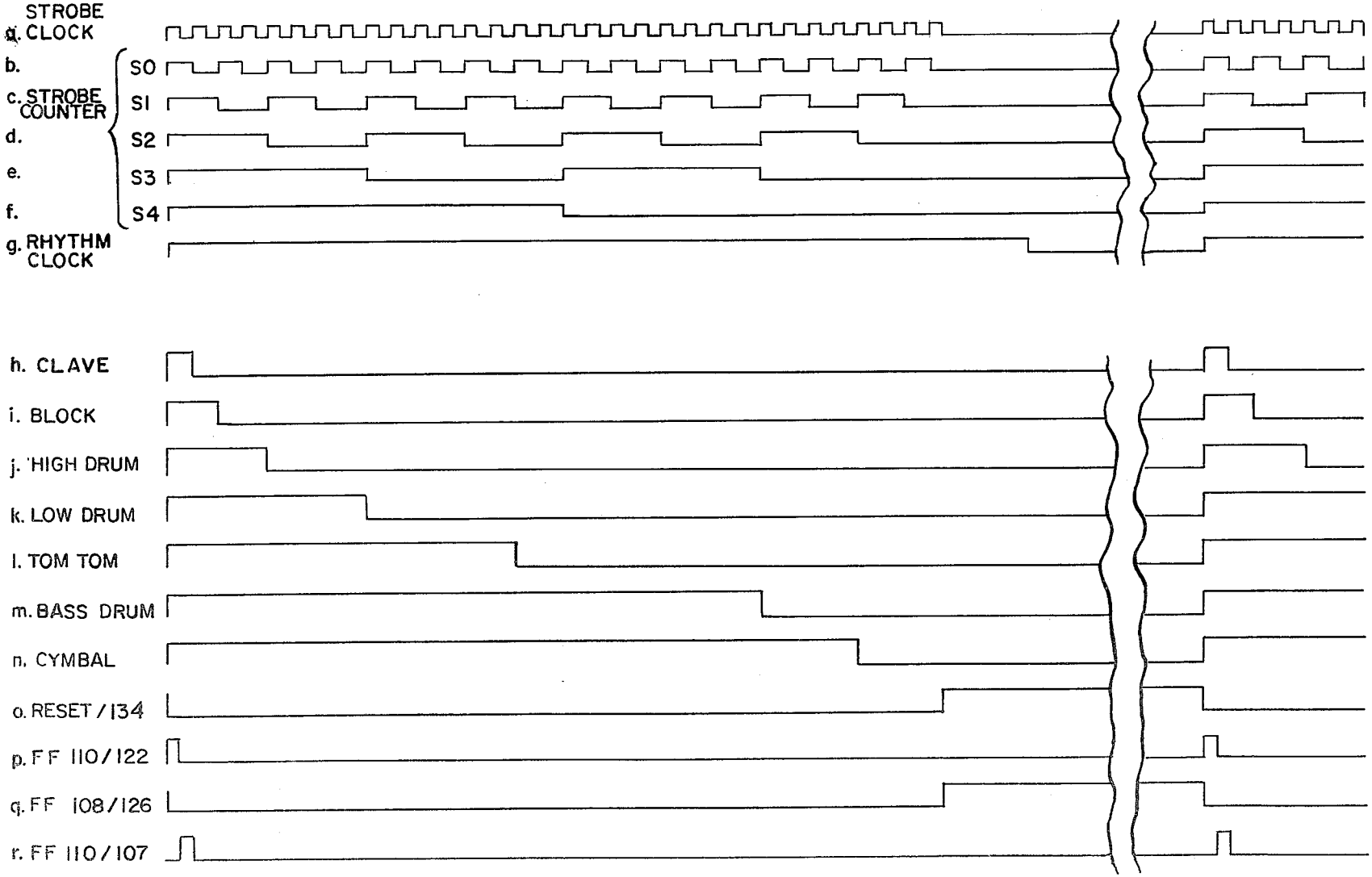

The rhythm clock 78 comprises a relaxation oscillator or other suitable oscillator for generating a rhythm clock signal which is a rectangular wave, pulse train, as shown in FIG. 2*g*. Preferably, the rhythm clock 78 has a variable circuit element 86 associated therewith for selectively varying the frequency of the rhythm clock signal produced on its output 88. The frequency of the rhythm clock signal establishes the periodic rhythm cycles and thereby establishes the tempo for the rhythm. A rhythm clock signal frequency ranging between 2 Hz and 10 Hz has been found suitable for most applications.

The rhythm clock output 88 is connected to a toggle input 90 of rhythm counter 80. Rhythm counter 80 comprises a conventional binary counter which advances by a count of one in response to the positive transition at the beginning of each 1-state pulse of the rhythm clock signal. The count of rhythm counter 80 is represented on its outputs R0, R1, R2, R3 and R4 in the form of binary logic 1-state and logic 0-state signals. The counter output pulses are applied to inputs 92 of the rhythm pattern memory 82 which decodes each of the counts represented thereby to produce the rhythm pulses on appropriate ones of its outputs 50–62.

For any given count, the rhythm pattern memory 82 produces a rhythm pulse on none, one or any combination of its outputs 50–62 depending upon the rhythm pattern which has been preselected through operation of pattern selection switches 84. The rhythm pulses are generated at a frequency determined by that of the rhythm clock and have a pulse width proportional to the period of the rhythm clock signal. Thus, during each rhythm cycle a logic 1-state signal is applied to the rhythm input 48 of none, one or more of the drive circuit AND gates 30–42.

The strobe pulse generator circuit 10, on the other hand, generates strobe pulses on all of its outputs 64–76 during every rhythm cycle. Those drive circuit AND gates which are in an enabled condition when a strobe pulse is applied thereto generate a corresponding drive pulse on their output, whole those that are not enabled do not generate a drive pulse.

The strobe pulse generator circuit 10 includes a strobe clock 94, a strobe counter 96, a strobe decoder circuit 98 and a control circuit 100 including a reset decoder 102, an inverter 104, and an AND gate 106, a bistable multivibrator or flip-flop 108 and a bistable multivibrator or flip-flop 110. The strobe clock 94 is a relaxation oscillator or any other suitable oscillator for producing a rectangular wave train on its output 112 at a selected frequency higher than that of the rhythm clock output signal. An illustrative strobe clock output signal is shown in FIG. 2*a*. The strobe clock 94 is an oscillator of the start-stop type having a control input 114 for receipt of a 1-state stop signal to cause termination of oscillation. When the control input 114 is in a logic 0-state, on the other hand, the strobe clock 94 is enabled to generate the strobe clock pulse train.

The strobe clock signal on output 112 is connected with a toggle input 116 of strobe counter 96. The strobe counter 96 is a conventional resettable binary counter having five information outputs S0, S1, S2, S3 and S4 on which pulses are produced representative of the count of the counter and a reset input 118. The counter output pulses produced on outputs S0–S4 in response to the strobe clock pulses shown in FIG. 2*a* are respectively shown in FIGS. 2*b*, 2*c*, 2*d*, 2*e* and 2*f*. The strobe counter 96 resets to a preselected count, such as zero, when a logic 1-state reset signal is applied to reset input 118.

The strobe counter outputs S0–S4 are respectively applied to five inputs 113 of the strobe decoder circuit 98. The strobe decoder circuit 98 decodes the various counts of strobe counter 96 to produce strobe pulses on its outputs 64, 66, 68, 70, 72, 74 and 76 as respectively shown in FIGS. 2*h*, 2*i*, 2*j*, 2*k*, 2*l*, 2*m* and 2*n* in a manner which will be described hereinafter with reference to FIG. 3.

The control circuitry 100 receives inputs from the strobe counter 96, output 64 of strobe decoder circuit 98, the strobe clock output 112 and the rhythm clock output 88 to control the strobe clock 94 and strobe counter 96 to synchronize generation of strobe pulses with the rhythm cycles established by rhythm clock 78. The rhythm clock output 88 is connected with a clock input 120 of flip-flop 110. Accordingly, when the rhythm clock signal switches to a 1-state at the beginning of a rhythm cycle, flip-flop 110 is caused to switch its normal output 122 to a 1-state, as shown in FIG. 2*p*. Output 122 is connected with a reset input 124 of flip-flip 108 which, in response to the 1-state signal applied thereto, switches its output 126 to a 0-state, as shown in FIG. 2*q*. The 0-state signal on output 126 is applied to both the control input 114 of strobe clock 94 to cause it to commence oscillating and to the reset input 118 to enable it to start counting, as illustrated in FIG. 2*a* and FIGS. 2*b*–2*f*, respectively. Alternately, the strobe clock 94 could be permitted to be free running with only the strobe counter 96 being controlled.

Flip-flop 110 is reset at the end of the first strobe clock pulse, as illustrated in FIG. 2*q*, in response to a reset pulse, illustrated in FIG. 2*r*, generated by AND gate 106 and applied to a reset input 107 of flip-flop 110. This reset pulse is generated by AND gate 106 at the end of the first strobe clock pulse in response to output 64 of strobe decoder circuit 98 and an output 137 of inverter 104, respectively applied to inputs 138 and 140 of AND gate 106, switching to a 1-state at that time.

All of the strobe counter outputs S0–S4 are applied by means of a cable 128 to respective inputs 130 (only one shown) of reset decoder 102. Another input 132 of reset decoder 102 is coupled with output 112 of strobe clock 94. At the end of the thirty-second strobe clock pulse (the last pulse illustrated in FIG. 2*a*), all of the inputs to reset decoder 102 are in a 0-state which causes the reset decoder to generate a 1-state reset pulse on its output 134. This pulse is applied to a clock input 136 of flip-flop 108. This causes flip-flop 108 to switch its output 126 to a 1-state to disable the strobe clock 94 and to reset strobe counter 96. The output 134 of reset decoder 102 remains in its 1-state condition when the strobe counter 96 is reset, for the counter is reset to the very same condition which causes the reset decoder 102 to generate the reset pulse in the first instance.

Figure 3:
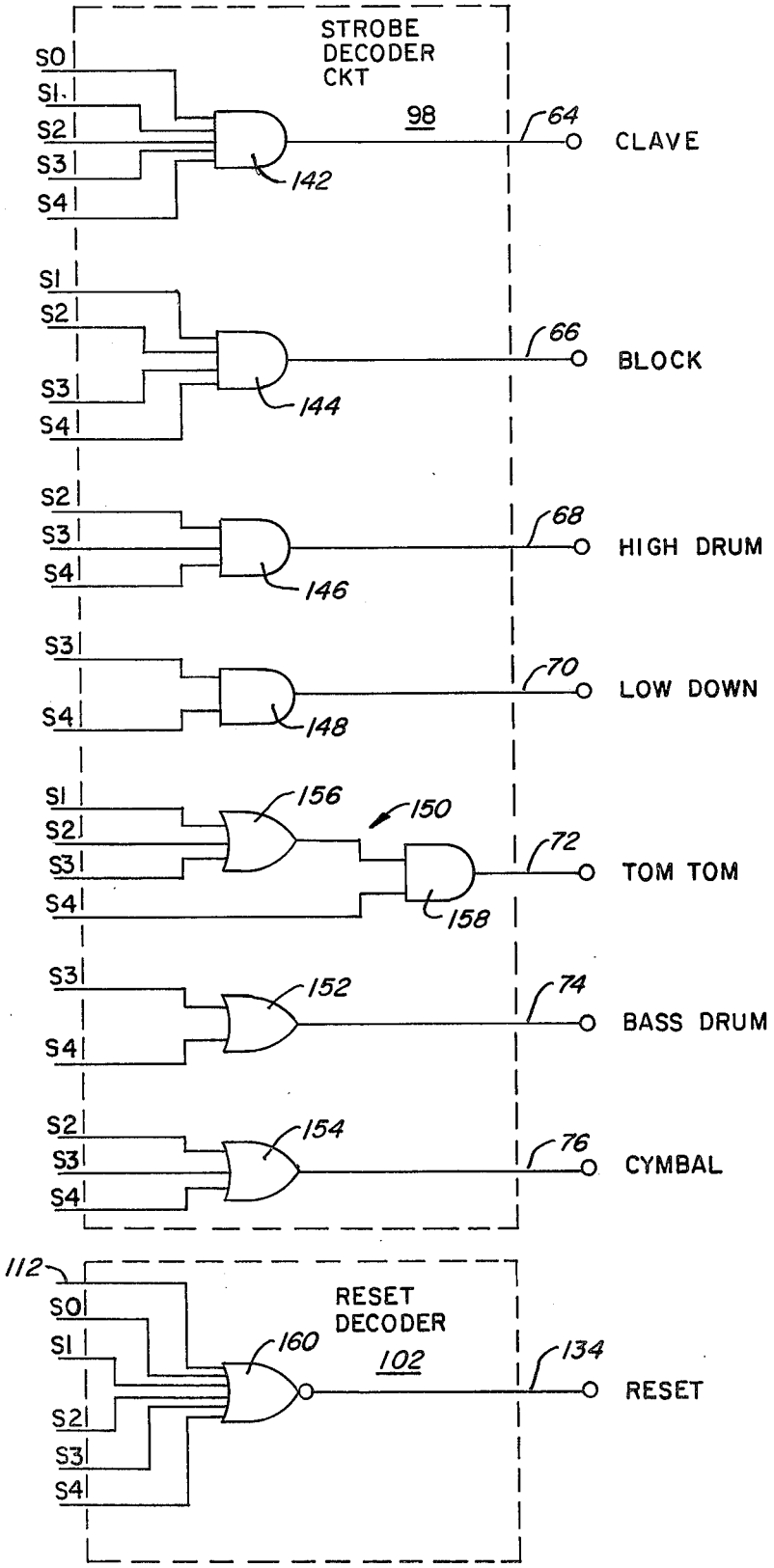
FIG. 3 is a circuit logic diagram of the circuitry corresponding to the strobe decoder circuit and the reset decoder blocks shown in FIG. 1.

Referring to FIG. 3, the strobe decoder circuit 98 is seen to comprise seven decoder circuits 142, 144, 146, 148, 150, 152 and 154 which respectively produce the strobe pulses on outputs 64–76. Each of decoder circuits 142, 144, 146 and 148 comprise a single AND gate having inputs connected to appropriate ones of the outputs of strobe counter 96 as indicated and produce their 1-state strobe pulses when, and so long as, all of the inputs thereto are in a 1-state. Decoder circuit 150, comprises an OR gate 156 and an AND gate 158 and produces its strobe pulse whenever any one or more of decoder outputs S2, S3 and S4 are in a 1-state while decoder output S5 is in a 1-state. Decoder circuits 152 and 154, each comprising a single OR gate, produce their strobe pulse output so long as any one of the strobe counter outputs connected therewith is in a 1-state.

Still referring to FIG. 3, the reset decoder 102 is seen to comprise a single NOR gate 160 having five inputs respectively connected with the five outputs of the strobe counter 96 and a sixth input connected with output 112 of strobe clock 94. The 1-state reset pulse is generated when all of these inputs are in a 0-state, as illustrated in FIG. 2*o*.

While a single preferred embodiment has been described in detail, it should be appreciated that numerous variations and alterations may be made thereto without departing from the scope of the invention. For example, while seven instrumentation circuits are shown, the automatic rhythm generator could be employed with a greater or lesser number of instrumentation circuits by making minor alterations thereto. Other similar variations are likewise contemplated. More generally, while the preferred embodiment has been disclosed as being an automatic rhythm generator, it should be appreciated that the inventive concept is useful in any application where instrumentation or other types of circuits require drive pulses of a preselected width for proper operation.

I claim:

1. In an automatic rhythm generator of an electrical musical instrument having a plurality of audio output signals corresponding to a plurality of different instruments, means for establishing periodic rhythm cycles, and means for choosing one or more of said instrumentation circuits for development of its output signal during selected rhythm cycles, each of said instrumentation circuits requiring application of a drive pulse thereto of an appropriate width therefor to properly produce its audio output signal, the required drive pulse width being different for at least two of said instrumentation circuits, a control circuit of the rhythm generator, comprising:

means for digitally generating a plurality of strobe pulses respectively associated with said plurality of instrumentation circuits, said strobe pulses being generated without regard to which associated instrumentation circuits have been chosen, each of said strobe pulses having a preselected width which is proportional to the drive pulse width for the instrumentation circuit with which it is associated the widths for at least two of said strobe pulses being different; and means responsive to generation of strobe pulses for those instrumentation circuits which have been chosen to provide drive pulses thereto of appropriate widths.

2. The automatic rhythm generator of claim 1 in which drive pulses are provided to only those instrumentation circuits which have been chosen.

3. The automatic rhythm generator of claim 2 in which said drive pulse providing means includes a plurality of logic gates respectively associated with said plurality of instrumentation circuits, means connected with said generating means for respectively applying said plurality of strobe pulses to said plurality of logic gates, and means responsive to said choosing means for enabling the logic gates associated with chosen instrumentation circuits to respond to receipt of a strobe pulse, enabled ones of said logic gates providing a drive pulse to their associated instrumentation circuits in response to application of a strobe pulse thereto.

4. The automatic rhythm generator of claim 3 wherein said choosing means includes means for generating a rhythm pulse on each of a plurality of outputs thereof respectively associated with said plurality of instrumentation circuits, a rhythm pulse being generated on each of said outputs associated with an instrumentation circuit to be chosen, if any, during each of said rhythm cycles, and said enabling means includes means responsive to generation of a rhythm pulse on any one of said outputs for enabling the logic gate associated therewith.

5. The automatic rhythm generator of claim 4 in which each of said logic gates has one input connected with an associated one of the plurality of outputs of the rhythm pulse generating means, another input connected with the strobe pulse generating means for receipt of an associated strobe pulse and an output, each of said logic gates generating a drive pulse on its output to an associated one of the instrumentation circuits during simultaneous receipt at its inputs of both a rhythm pulse and a strobe pulse.

6. The automatic rhythm generator of claim 1 in which said strobe pulse generating means includes means for synchronizing generation of said strobe pulses with establishment of said periodic rhythm cycles.

7. The automatic rhythm generator of claim 6 in which said periodic rhythm cycle establishing means includes a rhythm oscillator, and said synchronizing means includes a strobe oscillator, and means connected with the rhythm oscillator for enabling the strobe oscillator to begin oscillating in response to initiation of a rhythm cycle, and said strobe pulse generating means includes means responsive to said strobe oscillator for generating said strobe pulses, the pulse widths of said strobe pulses being determined by the frequency of the strobe oscillator.

8. The automatic rhythm generator of claim 7 in which the strobe oscillator oscillates at a higher frequency than that of said rhythm oscillator.

9. The automatic rhythm generator of claim 8 wherein the rhythm oscillator establishes the tempo of the generated rhythm and said strobe oscillator oscillates at a frequency which is independent of said tempo.

10. The automatic rhythm generator of claim 9 in which the rhythm cycle establishing means includes means for selectively changing the frequency of said rhythm oscillator to vary the tempo, the pulse widths of said strobe pulses being unaffected by said variations of tempo.

11. The automatic rhythm generator of claim 1 in which said strobe pulse generating means includes an oscillator means for counting cycles of said oscillator, and means responsive to said counting means for providing said strobe pulses, said strobe pulse providing means having a plurality of outputs respectively associated with said plurality of instrumentation circuits on which the strobe pulses therefor are provided.

12. The automatic rhythm generator of claim 11 wherein said strobe pulse providing means provides a strobe pulse on each of said outputs for a period commencing with a first count of said counting means and terminating with a second count of the counting means, the first and second counts for each of said outputs being preselected for the instrumentation circuit with which it is associated.

13. The automatic rhythm generator of claim 12 including means for detecting a predetermined count of said counting means and means responsive to said detecting means for resetting the counter to another predetermined count.

14. The automatic rhythm generator of claim 13 including means for preventing said counting means from counting upon being reset until the rhythm cycle next following the rhythm cycle in which the counting means is reset.

15. The automatic rhythm generator of claim 14 wherein said preventing means includes means for disabling said oscillator in response to detection of said first-mentioned predetermined count.

16. The automatic rhythm generator of claim 11 in which said counting means comprises a counter and said strobe pulse providing means includes a plurality of decoders for providing strobe pulses on the plurality of outputs of the strobe pulse providing means, each of said decoders decoding appropriate counts of said counter to provide its strobe pulse with the preselected width therefor.

17. The automatic rhythm generator of claim 11 in which said strobe pulse generating means includes means for synchronizing said oscillator with the periodic rhythm cycles.

18. In an electrical musical instrument having a plurality of instrumentation circuits for providing audio output signals, said instrumentation circuits producing their audio output signals when actuated by a drive pulse of appropriate width applied thereto, the appropriate drive pulse widths being different for at least two of said instrumentation circuits, a circuit for actuating said instrumentation circuits, comprising:

means for digitally generating a plurality of strobe pulses respectively associated with said plurality of instrumentation circuits, each of said strobe pulses having a width which is proportional to the required drive pulse width for the instrumentation circuit with which it is associated the widths for at least two of said strobe pulses being different;

means for selecting chosen ones of said instrumentation circuits for actuation; and means responsive to said strobe pulses for applying drive pulses to the chosen ones of the instrumentation circuits of appropriate pulse widths.

19. The electrical musical instrument of claim 18 in which said selecting means includes means for periodically changing the choice of instrumentation circuits for actuation, and said strobe pulse generating means includes means responsive to said selecting means for synchronizing generation of said strobe pulses with the periodic choice changes.

20. The electrical musical instrument of claim 18 in which said drive pulse applying means includes a plurality of logic gates respectively associated with said plurality of instrumentation circuits, means connected with said strobe pulse generating means for respectively applying said plurality of strobe pulses to said plurality of logic gates, and means responsive to said selecting means for enabling the logic gates associated with chosen instrumentation circuits to respond to application of a strobe pulse, enabled ones of said logic gates providing a drive pulse to their associated instrumentation circuits in response to application of a strobe pulse thereto.

* * * * *